US005421534A

United States Patent [19]

Arnold et al.

[11] Patent Number: 5,421,534

[45] Date of Patent: Jun. 6, 1995

[54] APPARATUS FOR AND METHOD OF CONTROLLING TENSION OF A FILAMENTARY MATERIAL

[75] Inventors: Ernst Arnold, Buchs; Hansrudi Sigrist, Adliswil, both of Switzerland

[73] Assignee: Meteor AG, Ruschlikon, Switzerland

[21] Appl. No.: 38,245

[22] Filed: Mar. 29, 1993

[30] Foreign Application Priority Data

Mar. 30, 1992 [CH] Switzerland ..... 01003/92
Dec. 9, 1992 [CH] Switzerland ..... 03765/92

[51] Int. Cl.[6] ..... B65H 59/00; B65H 23/18

[52] U.S. Cl. ..... 242/419.5; 242/419.8; 226/42/44

[58] Field of Search ..... 242/45, 75.51, 419.5, 242/419.8; 226/24, 42, 44, 45

[56] References Cited

U.S. PATENT DOCUMENTS 3,713,009 1/1973 Poppinger et al. .
4,011,976 3/1977 Greer .
4,129,238 12/1978 Herd .
4,368,411 1/1983 Kidd .
4,420,123 12/1983 Fox et al. .
4,480,799 11/1984 Yano et al. .
4,520,300 5/1985 Fradella .
4,644,234 2/1987 Nola .
4,708,301 11/1987 Kataoka .
5,039,027 8/1991 Yanagihara et al. .
5,045,134 9/1991 Schenker et al. .
5,240,194 8/1993 Noirot et al. .

FOREIGN PATENT DOCUMENTS 2420625 11/1975 Germany .
3936558 5/1991 Germany .
4035862 6/1991 Germany .

*Primary Examiner*—Daniel P. Stodola
*Assistant Examiner*—Michael R. Mansen
*Attorney, Agent, or Firm*—Burns, Doane, Swecker & Mathis

[57] ABSTRACT

To regulate the wire tension, a wire tension regulator is disposed on a winding device for electrical coils. A return roller and a contact roller can be mounted on the regulator for prebraking of the winding wire. The winding wire is subsequently wrapped 360° around a wheel brake. The wheel brake is driven in the forward and backward directions of the wire by a d.c. motor. A strain gauge is disposed between the brake wheel and the winding device. The d.c. motor generates a signal indicating a rotor position to a motor control unit which transmits the position as an amplified signal to a control device and, as a derived set value wire tension signal which also reaches the control device. In addition, a set value wire tension signal of a machine control unit or a set value wire tension signal of a wire tension preset is provided to the control device. The set value of the wire tension is compared with a signal representing the instantaneous wire tension. The control device emits a set value signal to the motor control unit which passes it along, amplified as an energy supply, to the d.c. motor to convert the tension of the wire from its present value to the set value.

16 Claims, 3 Drawing Sheets

APPARATUS FOR AND METHOD OF CONTROLLING TENSION OF A FILAMENTARY MATERIAL

FIELD OF THE INVENTION

The invention relates to an apparatus for and method of controlling the tension of a filamentary material, and, more particularly, to an apparatus for and method of controlling the tension of a wire being wound by a coil winding device to make an electrical coil.

BACKGROUND OF THE INVENTION

The tension forces on a wire being wound in a winding system for electrical coils must be kept constant at a preselected value. This is typically accomplished by disposing an automatic wire tension regulator between a wire supply roll and the coil-winding device. The demands on a wire tension regulator of this type are diverse, because the wire tension can fluctuate drastically during coiling due to the shape of the coil, which can be round, square, rectangular, oval, and so on. Also, wire tension can be affected by the increasing diameter of the coil during winding. During winding, it must also be taken into account that because of the technology and techniques used, the wire speed can also assume negative values, for example. The rapid effectiveness of the wire tension regulator is especially important, because delays caused by inertia can create uncontrollable wire-tension conditions that can greatly reduce the quality of the finished coil.

With conventional wire tension regulators, tension control is effected by mechanical means, electromechanical means, or some combination of these two. For example, tension control can be effected by a wire compensation arm that is associated with a potentiometer, if necessary.

Devices of this type have great disadvantages caused by inertia, particularly by after-running or braking of the wire during a negative wire speed occurring momentarily, and because of undesired oscillations of the wire compensation arm.

A device for controlling the tension of a wire being wound into an electrical coil is known from DE-OS 40 35 862. The device disclosed therein provides improvements by automatically controlling the wire tension and wire braking. The device comprises a preliminary brake formed by two felt-covered rollers. One of the rollers is permanently driven by a synchronous motor in a direction opposite to the feed direction of the wire. The other roller is carried along by the driving motor as a pad roller. The prestressed wire is guided at least 360° around a grooved roller driven by an additional motor in the forward and return directions of the wire. The grooved roller is connected to a counter which counts the revolution rate of the grooved roller and produces a signal, which a control unit uses to control the motor. A tensiometer produces a signal representative of the wire tension, which is compared to a set value. The resulting signal is superimposed onto the signal from the counter to produce a control signal which is sent to and affects the operation of the control unit. The change in wire tension influences the signal, and the speed of the motor is altered to suppress this change in tension.

At higher pulling speeds, the quality of the wound coil is adversely affected at a high wire speed by differences occurring in tension. To counteract the delays caused by inertia, the winding wire is fed over a spring-mounted pivoting arm. The winding wire then runs across a roller provided with an encoded disk for making the appropriate corrections to the counter signal by means of an additional control device.

A disadvantage that is associated especially with multiplex winding machines is that the spring force of the pivoting arm must be adapted individually for each winding position in each winding operation according to the type and thickness of the wire. Tension control of this type is less suitable for particularly thin winding wires that are wound at high pulling speeds and for which the frictional force alone is of importance.

SUMMARY OF THE INVENTION

In contrast to this prior art, it is an object of the present invention to provide a wire tension regulator and a method, particularly adapted for thin wires that must be wound at high pulling speeds, which avoid the need for compensation elements such as wire compensating levers, an encoded disk, and a preliminary brake with felt binders, each having additional, non-programmable adjustment elements that must be adjusted by hand.

The present invention exploits the fact that it is advantageous to regulate the torque of a brushless d.c. motor by means of a digital current regulator circuit, with which the speeds of the brake wheel can be derived in an advantageous way.

In such an arrangement, no additional devices are necessary for correcting the differences in tension in thin winding wires that occur at high speeds because an interference value modulation of the wire speed and wire acceleration is provided through the actual values of the amplified rotor position signals. The actual values for these functions are derived from the commutation system that is part of the d.c. motor.

Because no mechanical compensation devices are necessary for the fluctuations occurring in wire tension, the set value of the wire tension regulation can also be changed during the winding process without interruption.

A precise reproduceability of the winding process is attained by digitally presetting parameters and employing digital control circuits.

A further advantage is that all of the necessary control and regulating elements, including the power supply units, are integrated into the wire tension regulator, so that additional control devices are likewise unnecessary.

Because wire breakage is immediately detected and displayed by means of the accelerated return of the wire, all other devices which are necessary in the prior art can be eliminated. Moreover, no additional devices are necessary for determining the length of wire for each wound coil.

Through the use of a two-wire line (bus system), a multitude of wire tension regulators, for instance up to 32, which are individually programmable, can be connected to a common machine control unit of the winding machine, and statistical and operational data can additionally be collected and registered.

DETAILED DESCRIPTION OF THE PREFERRED EMBODIMENTS

Figure 1:
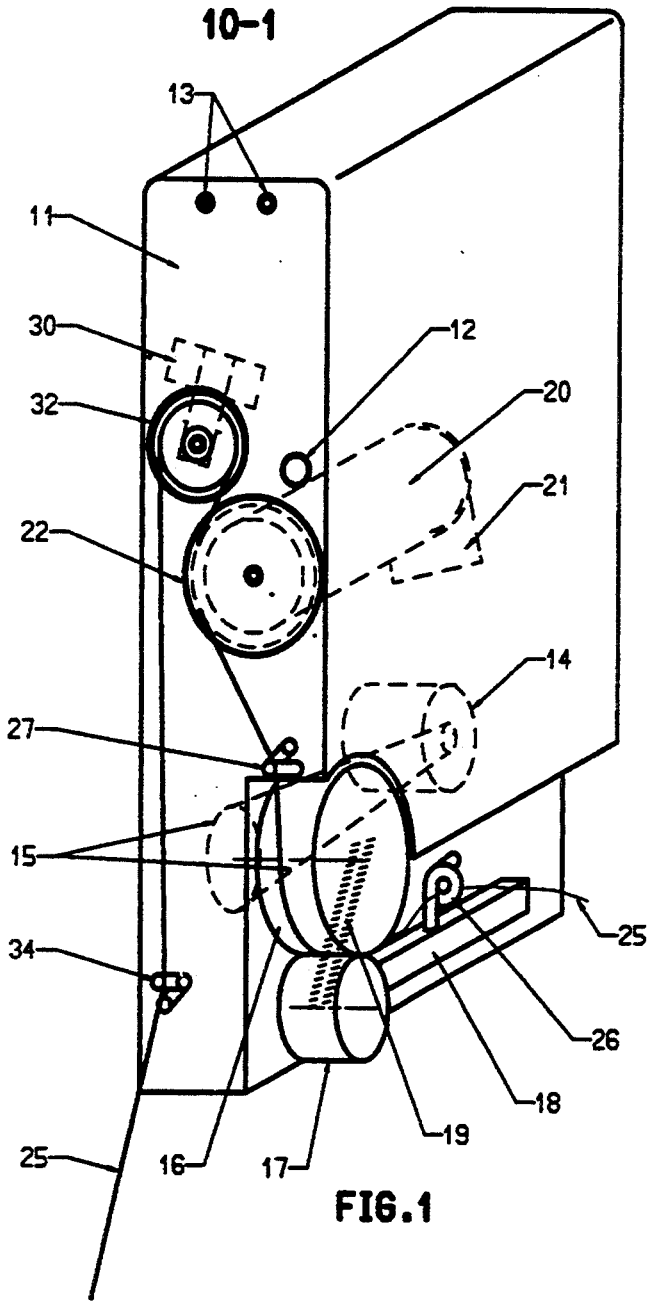
FIG. 1 is a perspective view of a presently preferred embodiment of the present invention.

The same parts are indicated with the same reference numerals in all drawings.

Figure 2A:
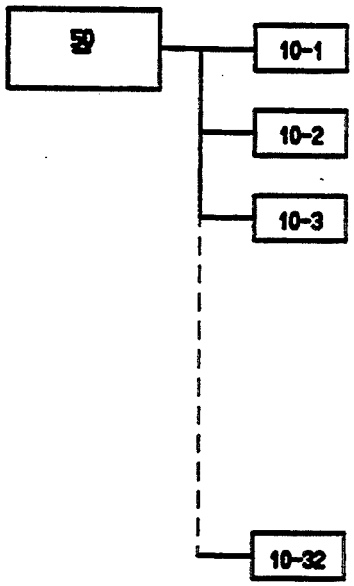
FIG. 2a is a schematic representation of a connector for connecting a plurality of wire tension regulators to a machine control unit in accordance with FIG. 2.
Figure 2:
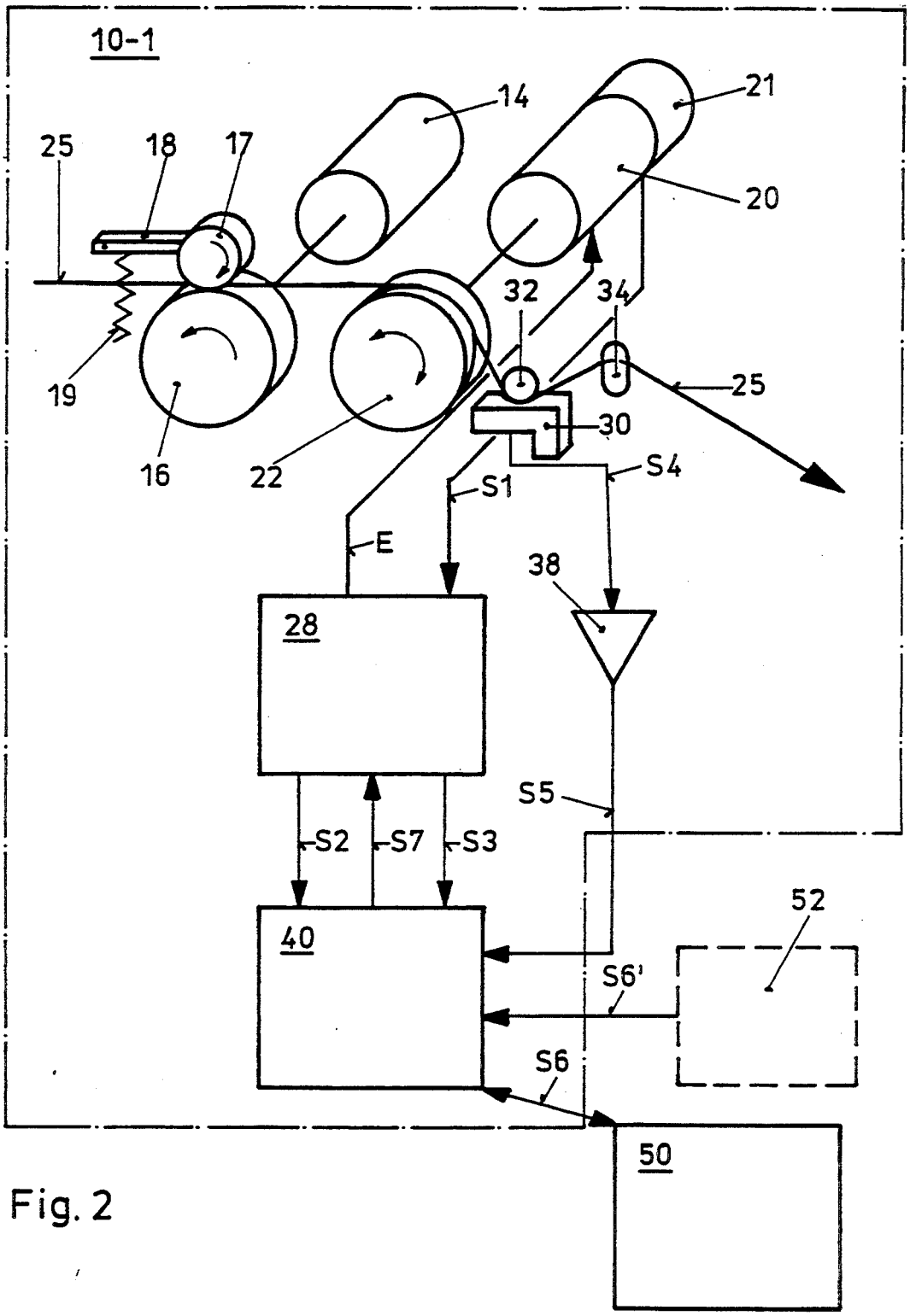
FIG. 2 is a partially schematic diagram of the embodiment of FIG. 1.

In accordance with FIGS. 1 and 2, numeral 25 indicates a winding wire. Although designated simply a winding wire herein, it will be understood that it may be any filamentary material, such as winding wires made of aluminum, copper, tungsten, gold, or platinum, or plastic or glass fibers preferably in the form of endless fibers. The winding wire 25 is fed from a supply coil (not shown) in the direction of the arrow, toward a wire tension regulator 10-1 between a return roller 16, driven by a d.c. motor 14 in the return direction of the wire by a transmission 15, and a contact roller 17, to which tension can be applied by a spring 19.

The contact roller 17, which is carried along by the return roller 16, is arranged so that it can be pivoted away from or toward the return roller 16. Depending on the type and size of the wire, the return roller 16, or the contact roller 17, or both are provided with appropriate linings made of felt, ceramics, metal, rubber, VULKOLAN and/or an anti-static material, for instance, while smooth linings made of anti-static material are preferred for thin winding wires.

The pressing force of the contact roller 17 can be changed through the adjustment of the length of the spring 19, depending on the type and size of the wire. The rotations of the return roller 16 vary to correspond to the wire speed. The winding wire 25 is then wound 360° around the groove in a brake wheel 22, and the brake wheel is driven in the forward or return direction of the wire by a brushless d.c. motor 20 with an incremental transmitter 21, controlled in four quadrants. The brake wheel 22 is likewise provided with a flexible lining, preferably made of rubber, VULKOLAN or the like, so that these measures assure non-skid wire guidance in the forward and return directions of the wire.

The applied tension of the winding wire 25 is subsequently detected continuously by a non-moving force-sensing device, preferably a strain gauge 30, in that the winding wire 25 is drawn across a measuring roller 32 and the strain gauge 30 and at a constant angle around a wire-reversing device 34, such as a loop or pig-tail guide, to a coil (not shown) of a winding device.

For better threading of the winding wire 25 between the return roller 16 and the contact roller 17, a wire-reversing device 26 is provided, as well as a further wire-reversing device 27 in the area beneath the brake wheel 22. An on-off switch 12 and an indicator 13 for indicating proper operation or a malfunction are likewise disposed on the front face of the housing 11 of the wire tension regulator. The indicator 13 may be an LED, which shows, for example, the color green when the device is operating properly, or red when it is malfunctioning.

The d.c. motor 20 is brushless and controlled in four quadrants, assuring a long service life, even at very high wire speeds of approximately 30 m/s. The motor control unit 28 receives a rotor position signal S1 transmitted by the d.c. motor 20 and delivers an amplified rotor position signal S2 to a control device 40. The motor control unit 28 also derives an actual value torque signal S3 from the energy supply E which is provided to the d.c. motor 20. Elements and signals 20, S1, 28, S3, 40 thus act together to form a digital current regulator circuit.

In addition, either a set value wire tension signal S6 programmed in a machine control unit 50 or, if no set value programming S6 is provided, a set value entered into a wire tension preselector 52 as a set wire tension signal S6' is transmitted to the control unit 40.

Figure 3:
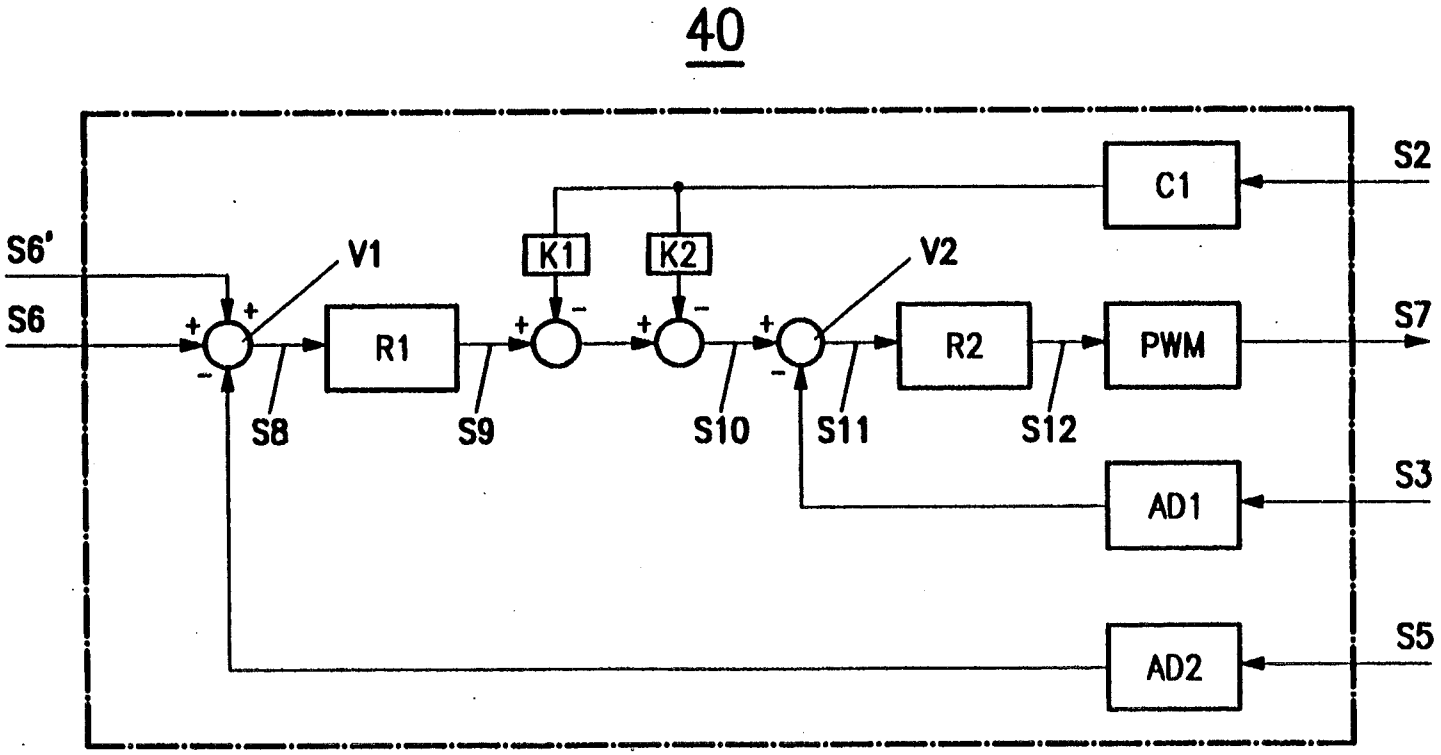
FIG. 3 is a functional diagram of a control unit in accordance with FIG. 2.

The set value wire tension signal S6 or S6' is compared with a signal S5 from amplifier 38. The signal S5 is the amplified signal S4 from the strain gauge 30 which represents the momentary wire tension. As indicated in FIG. 3, the control device 40 corrects the signal S8 resulting from the comparison of S5 and S6 (or S5 and S6') as necessary to produce a correcting variable signal S7 sent to the motor control unit 28. The motor control unit 28 amplifies the signal S7 to produce energy supply E and provides the energy supply E to the d.c. motor 20 to change the tension of the wire 25 from its current actual value to the set value. The digital wire tension regulation is superimposed onto torque control, and the d.c. motor 20 forms a closed-loop control circuit 30, S4, 38, S5, 40, S7, 28, E, 20 with the non-moving force-sensing device 30, which, as mentioned above, is preferably a strain gauge. The strain gauge 30 counteracts the tendency of the winding wire to oscillate in mechanical wire pull compensation elements, for instance.

As soon as the frictional force of the wire exceeds the set value wire tension S6 or S6' of the machine control unit 50 or the wire tension preselector 52, the braking function of the d.c. motor 20 changes to a driving function, which can occur especially with a thin winding wire 25 that runs at a high wire speed.

As will be explained in more detail in FIG. 3, the actual values of the wire speed K1 and the wire acceleration K2 are derived in the control device 40 from the amplified rotor position signal S2 from the commutation system that is part of the d.c. motor 20, wherein an increment transmitter 21 is disposed on the d.c. motor shaft for measuring the revolution rate (rpm) of the d.c. motor 20 and for measuring the length of the wire.

In secondary winding operations, such as displacement of the wire guide, or during backward rotation of the winding spindles, etc., a wire return of the type required by this technology is programmable by means of an occurring or existing wire return force in the machine control unit 50 or in the wire tension preselector 52. The wire is tightened by the wire return, and the wire length of the wire return is likewise programmable in the machine control unit 50.

The LED 13 displays the results of a wire breakage detection, which is derived from the return function and the wire acceleration, using the color red to indicate a malfunction.

Ordinarily, the winding machine for electrical coils has a plurality of, for instance up to 32, winding positions that are equipped with appropriate, individually programmable wire tension regulators 10-1–10-32 (FIG. 2A). The wire tension regulators 10-1–10-32 (FIG. 2A) are connected to the machine control unit 50 by a two-wire line, a so-called bus system, so that, besides the set value programming, other operations such as transmission of actual values, tolerance range programming (for example of wire expansion with triggering of an alarm when a set range has been exceeded), and wire regulation programming can be effected. In addition, statistical and operational data such as minimum or maximum wire pull per coil, and motor and expansion measurement operational data are collected and, if necessary, registered in the machine control unit 50.

Presetting digital parameters and the use of digital control circuits result in perfect reproduceability of the most diverse winding methods.

In the control device 40 in accordance with FIG. 3, the amplified rotor position signal S2 emitted by the motor control unit 28 is supplied to a counter C1 from whose count the correction signals K1, K2 for wire speed and wire acceleration are derived. The set value wire tension signal S6 or S6′ is compared with the amplified actual value wire tension signal S5, which has been digitized in an analog-to-digital converter AD2 and supplied by the strain gauge 30, in a comparator V1, and the difference signal S8 is supplied to a wire pull controller R1 whose output signal S9 is corrected by the correction signals K1, K2. This corrected signal S10 is compared with the actual value torque signal S3, which has been digitized in a further analog-to-digital converter AD1, in an appropriate comparator V2. The resulting signal S11 is transferred to a torque controller R2 whose output signal S12 processes it via a pulse wide modulator (PWM) into a set value signal S7. As already described, the set value S7 is amplified in the motor control unit 28 and supplied to the d.c. motor 20 as energy supply E.

What is claimed is:

1. An apparatus for regulating tension of a filamentary material, said apparatus comprising:

a brake wheel;

a force sensing element arranged to sense a tension on said filamentary material and for producing an actual tension signal indicative of said sensed tension;

motor means coupled to said brake wheel for driving said brake wheel and for generating a rotor position signal indicative of a sensed position of a rotor of said motor means;

setting means for setting a wire tension value and for generating a set wire tension value signal indicative of said set wire tension value;

a control device connected to said force sensing element and said setting means, and which receives said actual tension signal and said set wire tension value signal, for comparing said actual tension with said set wire tension value, and for producing a correcting signal at least partially on the basis of said comparing; and a motor control unit, responsive to said control device and arranged to receive said correcting signal, for supplying an energy signal to said motor means in accordance with said correcting signal to convert said actual tension to a desired tension represented by said set wire tension value, said motor control unit being responsive to said motor means for producing an amplified rotor position signal in response to said rotor position signal, and generating an actual torque signal derived from said energy signal, and wherein said control device receives said amplified rotor position signal and said actual torque signal and produces said correcting signal at least partially on the basis of said amplified position signal and said actual torque signal.

2. An apparatus as claimed in claim 1, wherein said motor means is a controlled d.c. motor.

3. An apparatus for regulating tension of a filamentary material, said apparatus comprising:

a brake wheel;

a force sensing element arranged to sense a tension on said filamentary material and for producing an actual tension signal indicative of said sensed tension;

motor means coupled to said brake wheel for driving said brake wheel and for generating a rotor position signal indicative of a sensed position of a rotor of said motor means;

a motor control unit responsive to said motor means for producing an amplified rotor position signal in response to said rotor position signal, for supplying an energy signal to said motor means, and for generating an actual torque signal derived from said energy signal;

setting means for setting a wire tension value and for generating a set wire tension value signal indicative of said set wire tension value; and a control device connected to said force sensing element, said motor control unit, and said setting means, and which receives said amplified rotor position signal, said actual torque signal, and said set wire tension value signal, for comparing said actual tension with said set wire tension value, for producing a correcting signal at least partially on the basis of said comparing, and for transmitting said correcting signal to said motor control unit for controlling said energy signal to convert said actual tension to a desired tension represented by said set wire tension value.

4. The apparatus of claim 3, wherein said motor means is brushless and has four-quadrant control.

5. The apparatus of claim 3, wherein said motor means, said motor control unit, and said control device in conjunction with said rotor position signal and said actual torque signal comprise:

a digital current control circuit which provides torque control for said motor means.

6. The apparatus of claim 5, wherein digital wire tension control is superimposed onto torque control, said motor means and said force sensing element being included in a closed-loop control circuit.

7. The apparatus of claim 3, further including:

an increment transmitter disposed on a shaft of said motor means for measuring rotational speed of said motor means and a length of said filamentary material.

8. The apparatus of claim 3, wherein said motor means changes a braking function into a driving function when said actual tension exceeds said set wire tension value.

9. The apparatus of claim 3, further including:

a return roller driven by said motor means in a return direction of said filamentary material; and means for controlling tension of said filamentary material in response to a wire return force.

10. The apparatus of claim 9, further including:

a machine control unit for controlling a wire length of the filamentary material driven in said return direction.

11. The apparatus of claim 9, further including:

means responsive to said force sensing element for indicating wire breakage when said filamentary material is driven in said return direction and controlled with a predetermined minimum wire acceleration.

12. The apparatus of claim 3, further including:

a return roller driven by said motor means in a return direction of said filamentary material, a rotational speed of said return roller varying according to speed of said filamentary material.

13. The apparatus of claim 12, wherein at least one of said brake wheel and return roller are made of one of the group consisting of felt, plastic, ceramic material, rubber, according to filamentary material type and size.

14. The apparatus of claim 13, wherein said brake wheel and return roller include:

an anti-static coating.

15. The apparatus of claim 3, wherein said control device includes:

means for determining correction signals for wire speed and wire acceleration based on said rotor position signal;

means for comparing said actual tension with said set wire tension value and generating a difference signal;

means for correcting said difference signal according to said correction signals and generating a corrected difference signal;

means for comparing said corrected difference signal with said actual torque position signal and generating a resulting signal;

means for converting said resulting signal into an energy supply signal for said motor means; and means for transmitting said energy supply signal to said motor means.

16. A method for regulating tension of a filamentary material wound between a pair of rollers and around a brake wheel, said rollers and said brake wheel being driven by a motor means, said method comprising the steps of:

detecting an actual tension of said filamentary material;

generating a rotor position signal associated with said motor means, an actual torque position signal according to energy supplied to said motor means, and a set wire tension value;

determining correction signals for wire speed and wire acceleration based on said rotor position signal;

comparing said actual tension with said set wire tension value and generating a difference signal;

correcting said difference signal according to said correction signals and generating a corrected difference signal;

comparing said corrected difference signal with said actual torque position signal and generating a resulting signal;

converting said resulting signal into an energy supply signal for said motor means; and transmitting said energy supply signal to said motor means.

* * * * *